US009204673B1

(12) United States Patent
Alperin et al.

(10) Patent No.: US 9,204,673 B1
(45) Date of Patent: Dec. 8, 2015

(54) WEARABLE BLANKET

(71) Applicants: Mindy Alperin, Great Neck, NY (US); Jamie Lazar, Great Neck, NY (US)

(72) Inventors: Mindy Alperin, Great Neck, NY (US); Jamie Lazar, Great Neck, NY (US)

( * ) Notice: Subject to any disclaimer, the term of this patent is extended or adjusted under 35 U.S.C. 154(b) by 0 days.

(21) Appl. No.: 14/736,446

(22) Filed: Jun. 11, 2015

Related U.S. Application Data

(60) Provisional application No. 62/013,632, filed on Jun. 18, 2014.

(51) Int. Cl.
*A41B 13/06* (2006.01)
*A47G 9/02* (2006.01)
*A41B 13/00* (2006.01)

(52) U.S. Cl.
CPC ..... *A41B 13/06* (2013.01); *A41B 13/005* (2013.01); *A47G 9/0223* (2013.01)

(58) Field of Classification Search
CPC ..... A41B 13/00; A41B 13/06; A41B 13/005; A41D 10/00; A41D 11/00; A41D 13/02
USPC ..... 2/75, 80, 83, 73, 79; 128/873, 872
See application file for complete search history.

(56) References Cited

U.S. PATENT DOCUMENTS 1,311,600 A * 7/1919 Fiore ..... 2/80
1,435,147 A * 11/1922 Burns ..... 2/80
2,374,299 A * 4/1945 O'Hara ..... 2/69.5
2,448,438 A * 8/1948 Kessler ..... 2/80
2,511,977 A * 6/1950 Garrison ..... 2/77
2,651,781 A * 9/1953 Buchholz ..... 2/69.5
2,663,873 A * 12/1953 Stern ..... 2/83
2,808,590 A * 10/1957 Siegel et al. ..... 2/80
2,876,455 A * 3/1959 Harmon ..... 2/80
2,999,244 A * 9/1961 Wright ..... 2/69.5
3,555,567 A * 1/1971 Owen ..... 2/69.5
3,641,997 A * 2/1972 Posey, Jr. ..... 128/873
4,726,076 A * 2/1988 Douez ..... 2/69
4,843,648 A * 7/1989 Goldberg ..... 2/80
5,058,208 A * 10/1991 Adams ..... 2/80
6,266,822 B1 7/2001 Joyce
6,837,880 B2 * 1/2005 Trimble ..... 604/393
D510,792 S 10/2005 Vazquez
7,246,392 B2 7/2007 Schmid (Continued)

FOREIGN PATENT DOCUMENTS

WO WO2007030726 3/2007
WO WO2011127110 10/2011

OTHER PUBLICATIONS

Anonymous, Sleeping Bags for Babies & Toddlers—Love to Dream, webpage, Jun. 11, 2015, http://www.lovetodream.com.au/online-shop/inventa-sleep-bag/.

*Primary Examiner* — Gloria Hale
(74) *Attorney, Agent, or Firm* — Werschulz Patent Law, LLC

(57) ABSTRACT

A wearable blanket having a sack with an integrated crotch that keeps the upper portion of the garment in a fixed position on an infant wearer. The wearable blanket cannot twist on the wearer or slide up to the head, but maintains full freedom of leg movement. In one embodiment, the wearable blanket has a diagonal closure extending from an armhole to an opposing bottom quadrant. In another example embodiment, the wearable blanket has a perimeter closure, extending from an armhole around the sack perimeter. In another embodiment, the wearable blanket is a footed sleeper with a diagonal opening.

20 Claims, 7 Drawing Sheets

(56) References Cited

U.S. PATENT DOCUMENTS

| | | | | |
|---|---|---|---|---|
| 7,254,849 | B1 * | 8/2007 | Fiebrich et al. | 5/482 |
| D650,153 | S | 12/2011 | Chopak | |
| 8,276,224 | B1 | 10/2012 | von Yurt | |
| 8,365,325 | B2 * | 2/2013 | Schneider | 5/494 |
| 8,607,364 | B2 | 12/2013 | Barski | |
| 2010/0257654 | A1 | 10/2010 | Waters | |

* cited by examiner

WEARABLE BLANKET

CROSS-REFERENCE TO RELATED APPLICATIONS

This application is a nonprovisional utility application of the provisional patent application Ser. No. 62/013,632 filed in the United States Patent Office on Jun. 18, 2014 and claims the priority thereof and is expressly incorporated herein by reference in its entirety.

TECHNICAL FIELD

The present disclosure relates generally to a sleep garment for infants and young children. More particularly, the present disclosure relates to an improved wearable blanket sleep garment for infants and young children.

BACKGROUND

The following document is incorporated by reference in its entirety into this disclosure as if fully set forth herein: U.S. Pat. No. 8,312,565, "Baby sleep and comfort aid," disclosing and claiming a fabric flap attaching to an infant garment as a sleep and comfort aid.

Recent studies show that placing an infant in a crib without anything in it, even a blanket, decreases the probability that the child will be a victim of Sudden Infant Death Syndrome (SIDS). Now wearable blankets are the garments of choice by parents when placing their child in the crib.

Wearable blankets for infants have always been popular because infants tend to kick blankets off, waking themselves and their parents when they get cold. The wearable blanket, sometimes called a sleep sack is a sack or pouch that covers the baby's body having a neck opening and armholes with or without sleeves, enclosing the baby's torso and legs within the sack.

While these sleep sacks provide comfort and security, infants still squirm and kick, resulting in the wearable blanket getting twisted around the child's lower torso and legs, inhibiting movement. The sleep sack when so twisted can even cover the face or head of the child. The baby so entwined in the wearable garment cry out, waking the parents.

Other sleepwear that keeps the infant warm without a blanket is the footed sleeper. The footed sleeper is generally fabricated from blanket type materials and substitutes for the blanket. While the footed sleeper is snug and stays in place, it is also challenging to put on a squirming infant.

While these garments may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a garment that replaces a blanket for an infant wearer. Accordingly, the present disclosure provides a wearable blanket for an infant wearer having a sack, a neckline and a pair of armholes.

Another aspect of an example embodiment in the present disclosure is to provide a garment that provides an infant wearer with room for wearer's legs to freely move while maintaining a cover over the wearer. Accordingly, the present disclosure provides a wearable blanket having a large sack that covers the infant torso and legs, allowing the legs to freely move within the sack while maintaining a cover over the infant wearer.

A further aspect of an example embodiment in the present disclosure is to provide a wearable blanket that prevents entanglement by an infant wearer. Accordingly, the present disclosure provides an integrated crotch covering within a sack, the integrated crotch maintaining the garment on the infant torso.

Yet another aspect of an example embodiment in the present disclosure is to provide a wearable blanket that prevents the garment from twisting on the infant torso and covering the infant head. Accordingly, the present disclosure provides a wearable blanket with an integrated crotch that maintains the garment on the infant torso, the integrated crotch attaching to sack at a mid-section, maintaining full freedom of the wearer's leg movement.

Yet a further aspect of an example embodiment in the present disclosure is to provide a device that makes a wearable blanket easy to place on an infant. According, the present disclosure provides a diagonal opening with a closure that extends across the front of a wearable blanket that opens up the garment for easy placement of an infant into the garment.

Accordingly, the present disclosure describes a wearable blanket having a sack with an integrated crotch covering that keeps the garment in a fixed position on an infant wearer. The wearable blanket cannot twist on the wearer or slide up to the head, but maintains full freedom of leg movement. In one embodiment, the wearable blanket has a diagonal closure extending from an armhole to an opposing bottom quadrant. In another example embodiment, the wearable blanket has a perimeter closure, extending from an armhole around the sack perimeter. In one embodiment, the wearable blanket is a footed sleeper with a diagonal opening.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
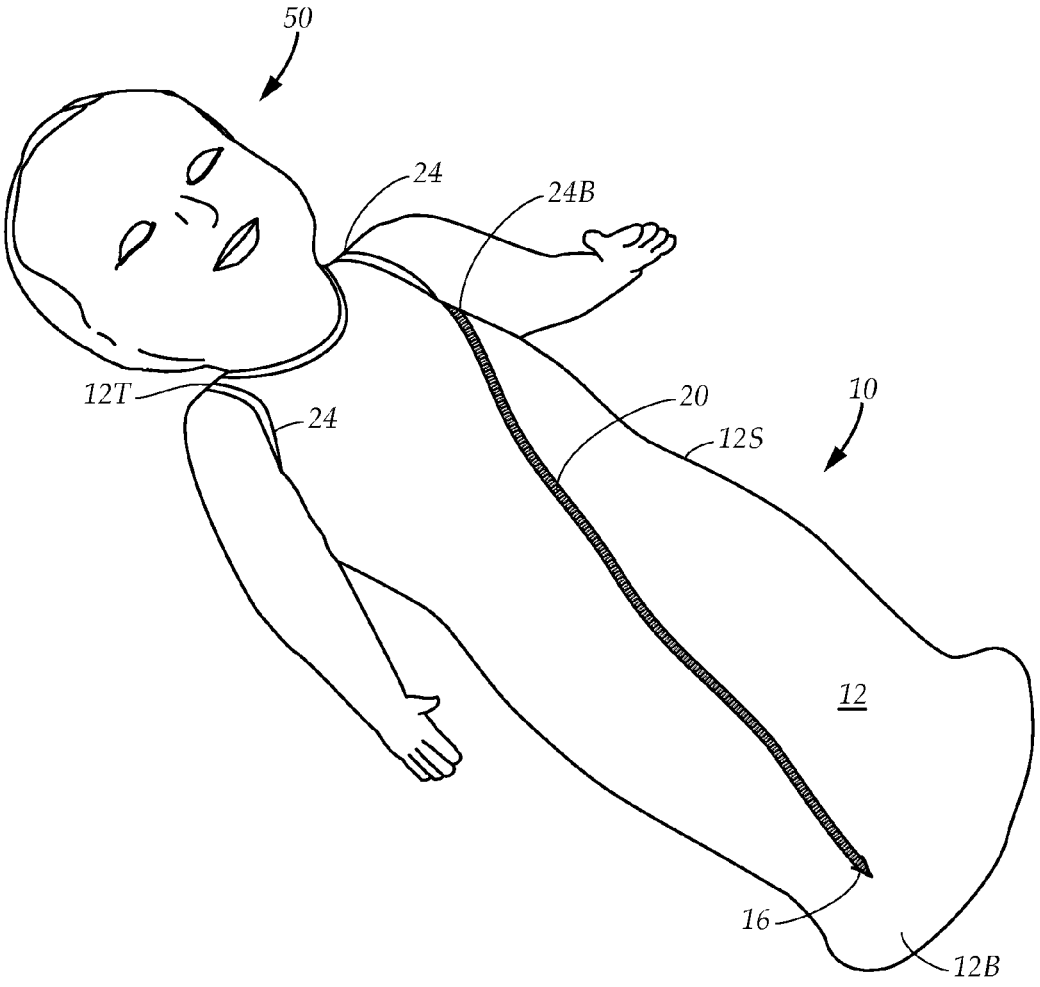
FIG. 1 is perspective view of an example embodiment of a wearable blanket sleep sack with a closed diagonal opening.

FIG. 1 illustrates a sleep sack 10 enclosing a wearer's 50 torso and legs, allowing the wearer's legs to move freely within the sack. The sleep sack 10 is a wearable blanket style of infant garment. It has a bag-like shape and can substitute for a blanket for sleeping. The wearable sack 10 has a pair of armholes 24, fitting over the wearer 50 with arms exposed.

In the example embodiment shown in the drawing, the sack 10 has a front panel 12 having a pair of sides 12S, a bottom 12B and a top 12T. The sack 10 has a diagonal opening 16 across the front panel 12 extending from an armhole 24 to the bottom 12B of the front panel 12. In the example embodiment, the diagonal opening 16 terminates at a bottom 24B of the armhole 24. The opening has a closure 20 selectively opens and closes.

The closure 20 can be a zipper, a hook and loop fastener, or a plurality of snaps, buttons, magnets as non-limiting examples and other acceptable garment closures suitable for infants known to those of ordinary skill can be employed.

In another example embodiment, the closure 20 can also have a top tab, which is not shown, to secure the closure 20 when in a closed position, the tab below the armhole 24 over the closure.

In this illustration as well as other illustrations in the present disclosure, the opening is shown terminating at the left armhole. It is understood that the opening can mirror this configuration, and that the mirror image is within the inventive concept.

Figure 3:
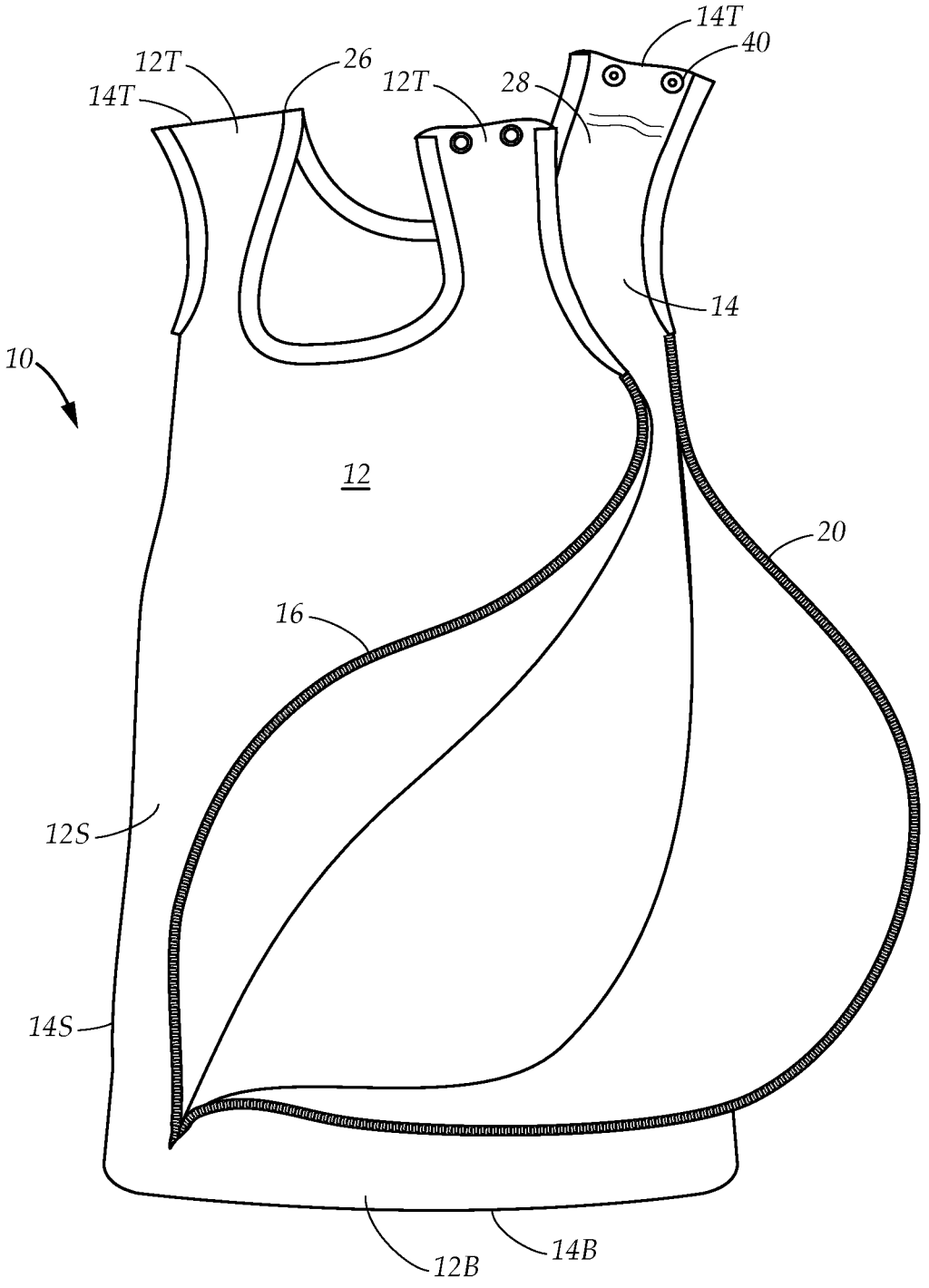
FIG. 3 is perspective view of an example embodiment of a wearable blanket sleep sack with an open diagonal opening.

FIG. 3 illustrates the sleep sack 10 with the opening 16 selectively open. The diagonal opening 16 on the front panel 12 provides an enlarged opening in the garment and makes it easier to place an active infant in the sleep sack 10. The diagonal opening 16 makes diaper changing easier with a larger opening that provides both more space in a horizontal direction as well as a vertical direction.

The sack 10 has a back panel 14. The back panel 14 has a pair of sides 14S, a bottom 14B and a top 14T. The back panel 14 couples to the front panel 12 at the bottom 12B. The back panel 14 partially couples to the front panel 12 at the sides 12S, leaving the sides open near the top 12T of the front panel 12 and the top 14T of the back panel 14 for forming armholes 24.

The sack 10 has a pair of shoulders 26, 28 coupling the panels 12, 14 together at the top. A first shoulder 28 is adjacent to the armhole 24 terminating the diagonal opening 16. The first shoulder selectively fastens the front panel 12 and the back panel 14 together with at least one fastener 40. The fastener 40 is selected from the group consisting of snaps, hook and loop fasteners, buttons and magnets.

When the diagonal opening 16 is selectively open and the first shoulder 28 is selectively open, it is appreciably easier to place the infant inside the garment 10, even when the active infant squirms and kicks. The diagonal opening 16 allows the shoulder 28 to be simultaneously open, providing a significantly enlarged opening, something a vertical center opening found in the prior art and universal to infant clothing, does not provide. The two novel features make this example embodiment of the garment especially easy for dressing the infant.

The sleep sack 10 is a unitary garment, that is, when it is assembled by sewing or fixing the panels together, it is one piece and is worn as one piece. In particular, the sleep sack 10 can be cut from one continuous piece of fabric or from a plurality of fabric segments that are assembled together.

In another example embodiment, which is not shown in the drawing, a sleeve attaches to each armhole 24 and the opening terminates at the armhole 24 at the top 12T of the panel 12 adjacent to the sleeve. In this position, the shoulder 28 selectively opens and closes along with the diagonal opening.

Figure 4:
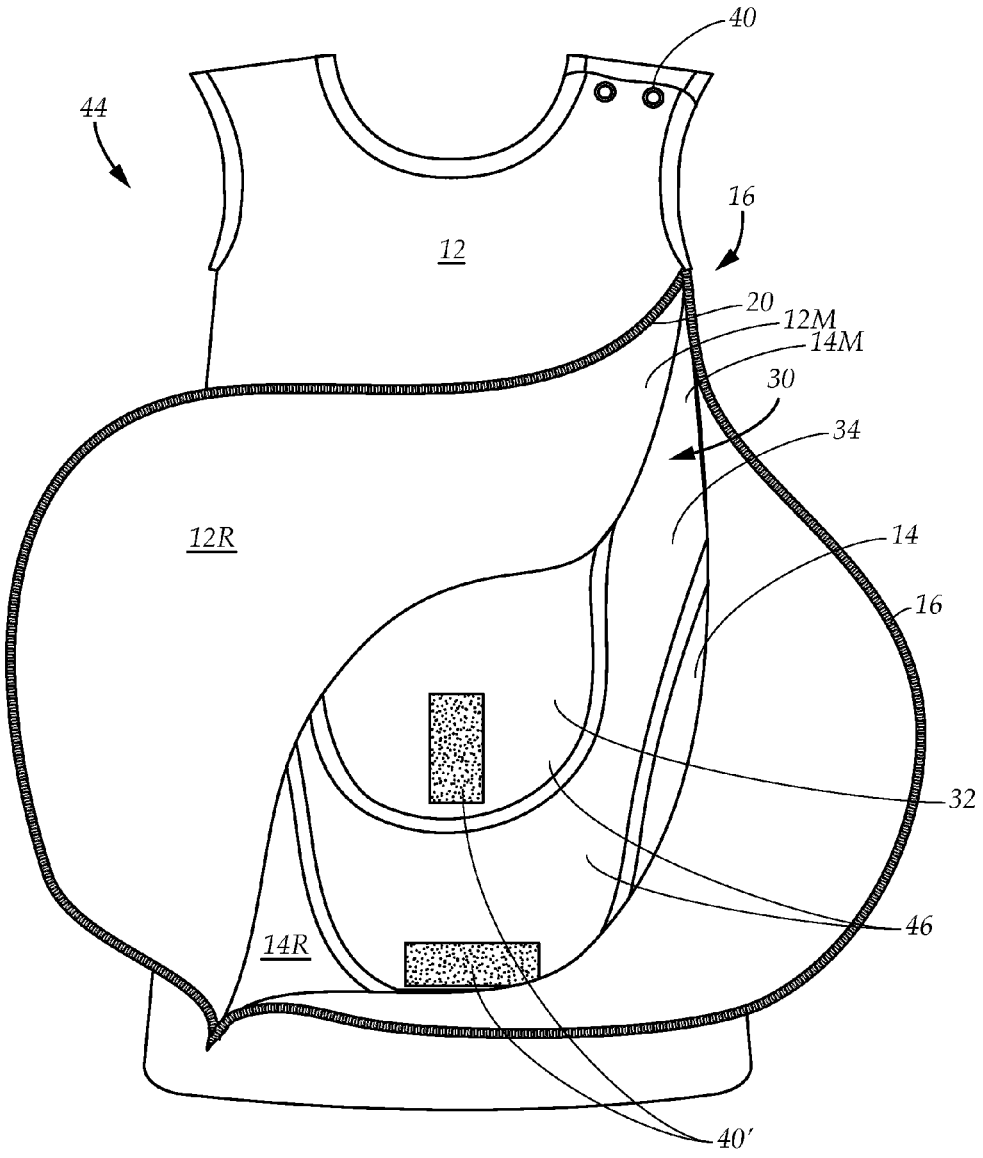
FIG. 4 is a perspective view of an example embodiment of the wearable blanket sleep sack with an open diagonal opening and an open integrated crotch.

In FIG. 4, another example embodiment of the sleep sack 44 is shown. Sleep sacks 44 are large and roomy garments, providing space for movement. As the infant wearer moves around in the wearable blanket, the sack 44 can twist or slide up, covering part of the wearer's head because the garment is so roomy and provides excess material to allow for free movement.

In this example embodiment of the sleep sack 44 with the diagonal opening 16, inside there is an inner integrated crotch covering 30 that prevents the sack 44 from twisting and sliding up and, in particular, from covering the wearer's head. The crotch covering 30 maintains the sack 44 on the lower portion of the wearer's torso, preventing excessive distortion of the garment shape as explained hereinbelow.

The front panel 12 has a reverse side 12R to the fabric. The back panel 14 has a reverse side 14R to the fabric. The crotch covering 30 has a front portion 32 and a back portion 34.

The integrated crotch covering 30 attaches inside the sleep sack 44, the front portion 32 attaching the reverse side 12R of the front panel 12 around the mid-section 12M of the front panel 12 and the back portion 34 attaching on the reverse side 14R of the back panel 14 around the mid-section 14M of the back panel 14.

The front portion 32 and the back portion 34 each having a tapered bottom 46. The taper bottoms have a fastener 40'. The fastener 40' is selected from the group consisting of snaps, hook and loop fasteners, buttons and magnets. In the drawings fastener 40 is shown as snaps and fastener 40' is shown as hook and loop fastener but these are not limitations and members of the group can be freely substituted.

The sleep sack 44 is a unitary garment when assembled.

In still another example embodiment, the sleep sack 44 includes at least one sleep and comfort aid flap attaching to the front panel 12. The sleep and comfort aid flap are fully described in U.S. Pat. No. 8,312,565. Because the sleep sack 44 is now stably maintained around the wearer's body, the sleep and comfort aid flap can be provided without fear of suffocation or choking.

Figure 5:
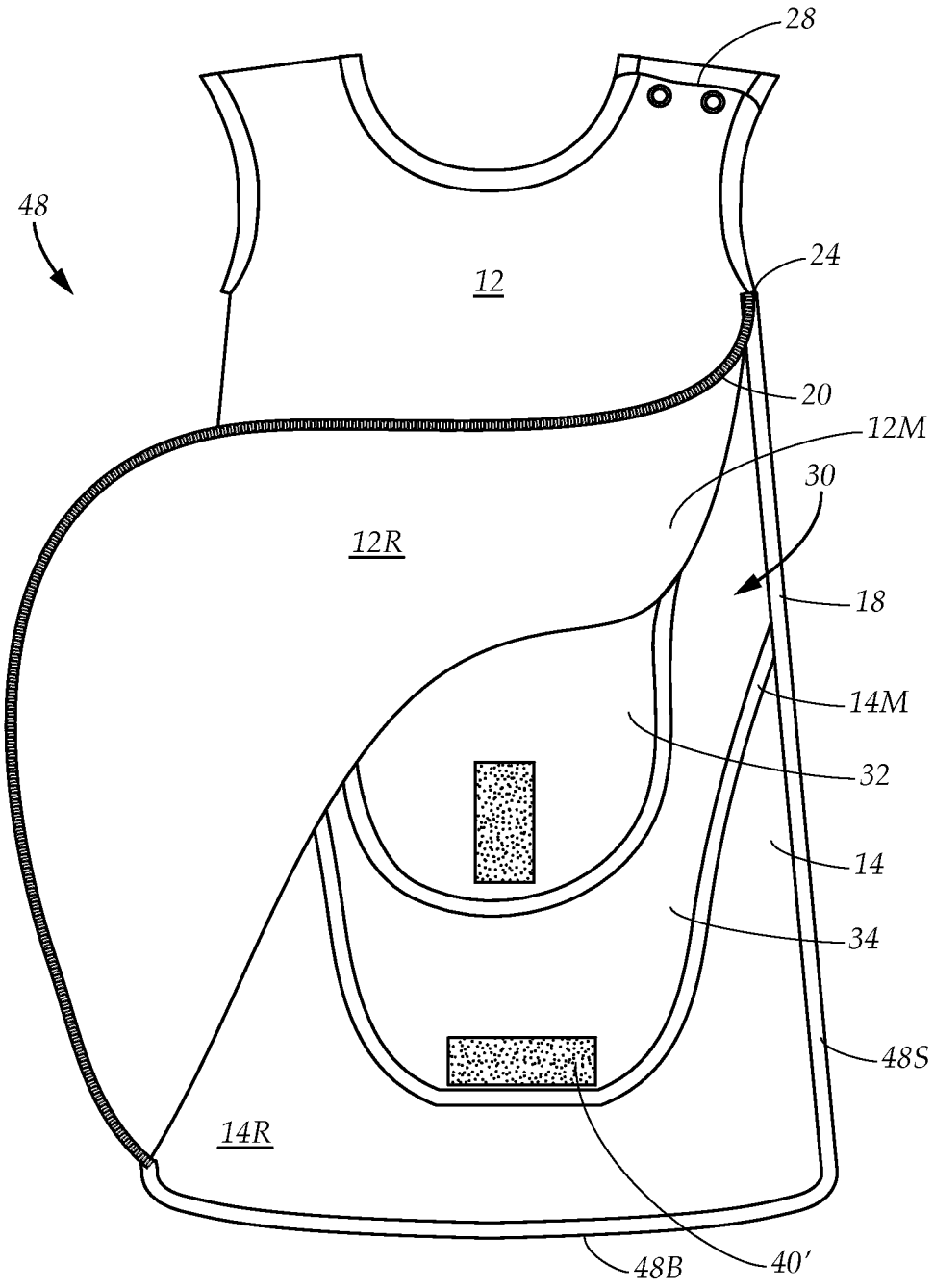
FIG. 5 is a perspective view of an example embodiment of the wearable blanket sleep sack with an open perimeter opening and an open integrated crotch.

In another example embodiment illustrated in FIG. 5, the sleep sack 48 has a perimeter opening 18 with a closure 20. The perimeter opening 18 extends from the armhole 24, down the side 48S and across the bottom 48B of the sack 48. Similar to the diagonal opening described hereinabove, the perimeter opening 18 provides an easier method of dressing an infant. When the perimeter opening 18 is selectively open and the first shoulder 28 is selectively open, it is appreciably easier to place the infant inside the garment 44, even when the active infant squirms and kicks. The opening 18 allows the shoulder 28 to be simultaneously open providing a significantly enlarged opening, something a vertical center opening found in the prior art and universal to infant clothing, does not provide.

As explained hereinabove with regard to FIG. 4, in the example embodiment shown in FIG. 5, the integrated crotch covering 30 attaches inside the sleep sack 48, the front portion 32 attaching the reverse side 12R of the front panel 12 around the mid-section 12M of the front panel 12 and the back portion 34 attaching on the reverse side 14R of the back panel 14 around the mid-section 14M of the back panel 14. The front portion 32 and the back portion 34 each having a tapered bottom 46. The taper bottoms have a fastener 40'.

Figure 6:
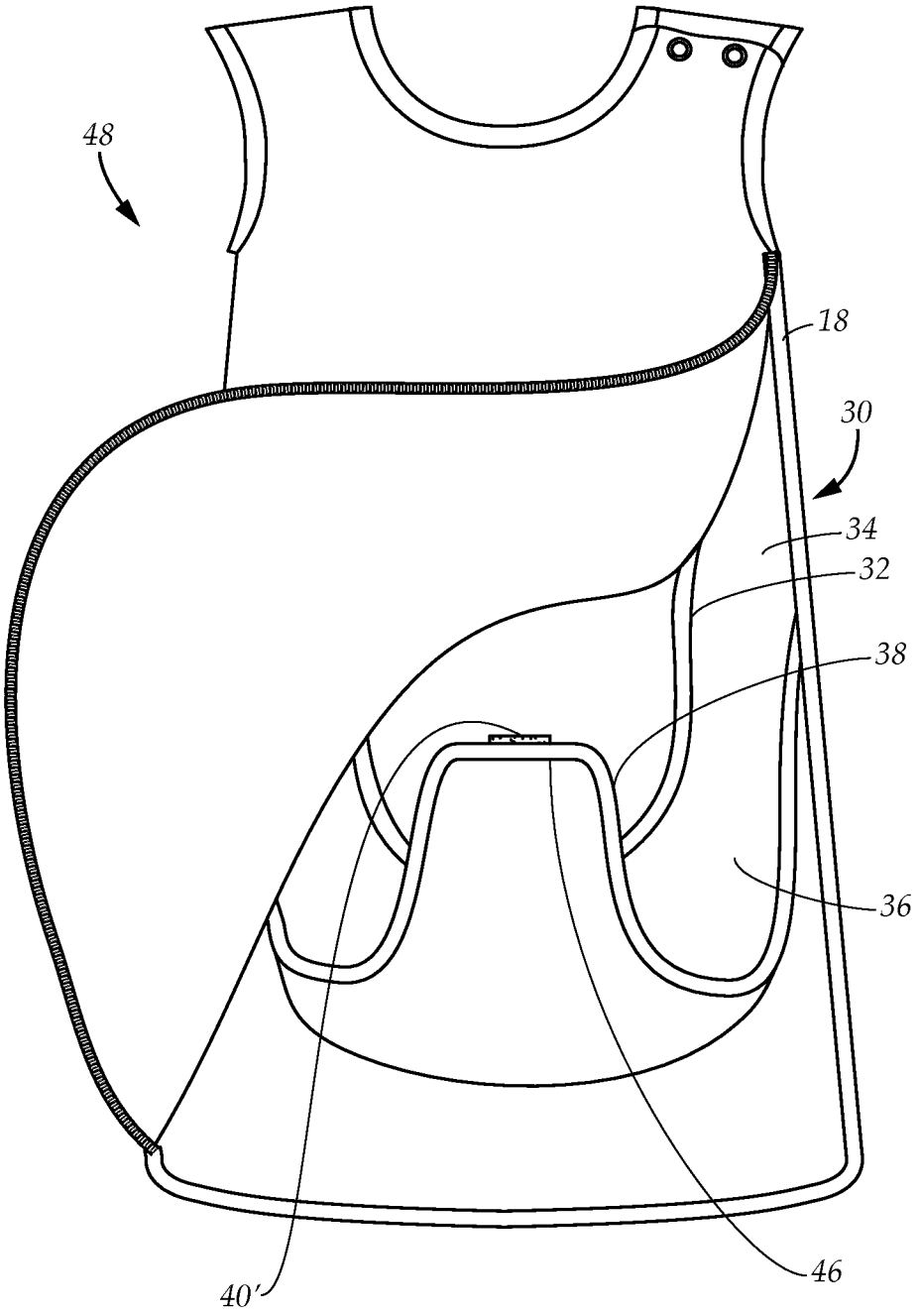
FIG. 6 is a perspective view of the example embodiment of the wearable blanket sleep sack with an open perimeter opening and a closed integrated crotch.

FIG. 6 shows the example embodiment having the perimeter opening 18 with the crotch covering 30 in a closed position. The tapered bottoms 46 of the crotch covering 30 selectively couple together forming a crotch 38, the crotch covering 30 configured for securing an infant's lower body in the sleep sack 48 when coupling together. When the bottoms 46 couple together the integrated crotch covering 30 has a pair of leg holes 36 adjacent to the bottom portion.

The sleep sack 48 is a unitary garment when assembled.

Figure 7:
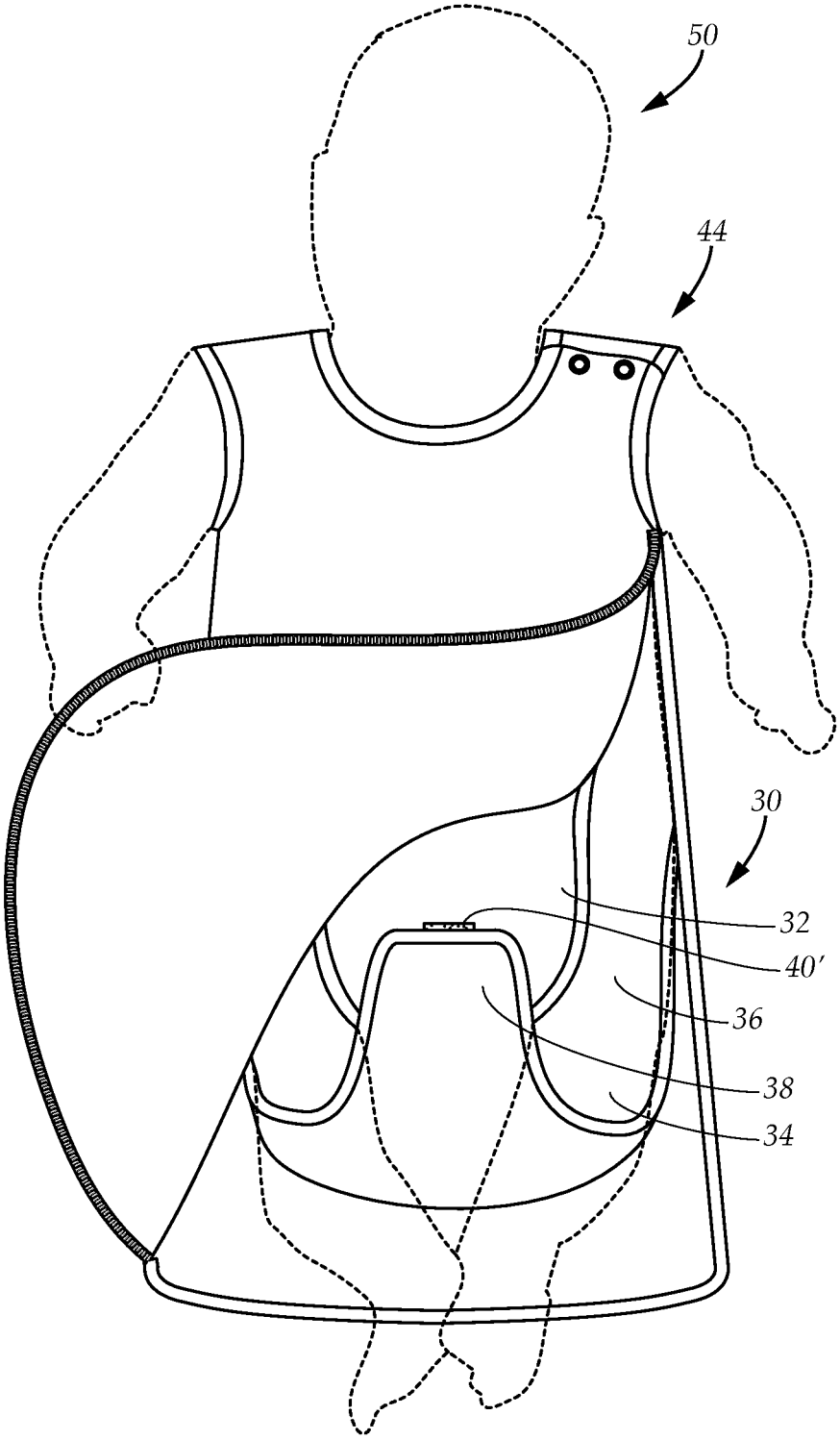
FIG. 7 is a perspective view of an infant wearing the wearable blanket sleep sack with the open perimeter opening and closed integrated crotch.

As demonstrated in FIG. 7, showing the example embodiment demonstrated in FIG. 5 disposed on an infant 50, the crotch covering 30 secures the infant wearer 50 in place inside the sack 44 with the crotch 38 secured by the fastener 40'. The crotch covering 30 is configured so that the crotch 38 of the crotch covering 30 coincides with the crotch of the wearer 50. The legs of the infant 50 are maintained in the leg holes 36. In the illustrated example embodiments, the back portion 34 of the integrated crotch covering 30 is longer than the front portion 32, the back portion 34 overlapping the front portion 32. This is not a limitation and the front portion 32 and back portion 34 can be of equal length.

The shapes of the back portion and front portion of the crotch covering are not limitations. Other example embodiments are possible within the inventive concept such as substantially triangular shaped crotch covering portions, the portions shaped generally like an isosceles triangle or rectangles. The portions each have a base that attaches to the sack as described hereinabove and bottoms that couple together.

In yet another example embodiment, the integrated crotch is a brief pant having a waist opening, the waist opening having a front and a back, the back of the waist opening attaching to the back of the sack reverse side, the crotch of the brief pant fixed together forming the leg holes. In a further example embodiment, the front of waist opening of the brief pant attaches to the reverse side of the front panel of the sack. In still a further example embodiment, the brief pant waist attaches to both the front and back panels.

In other example embodiments, the sleep sack with the integrated crotch covering has a center opening down the front panel. The sleep sack with the integrated crotch can have other openings known to those of ordinary skill in addition to those described herein.

Figure 2:
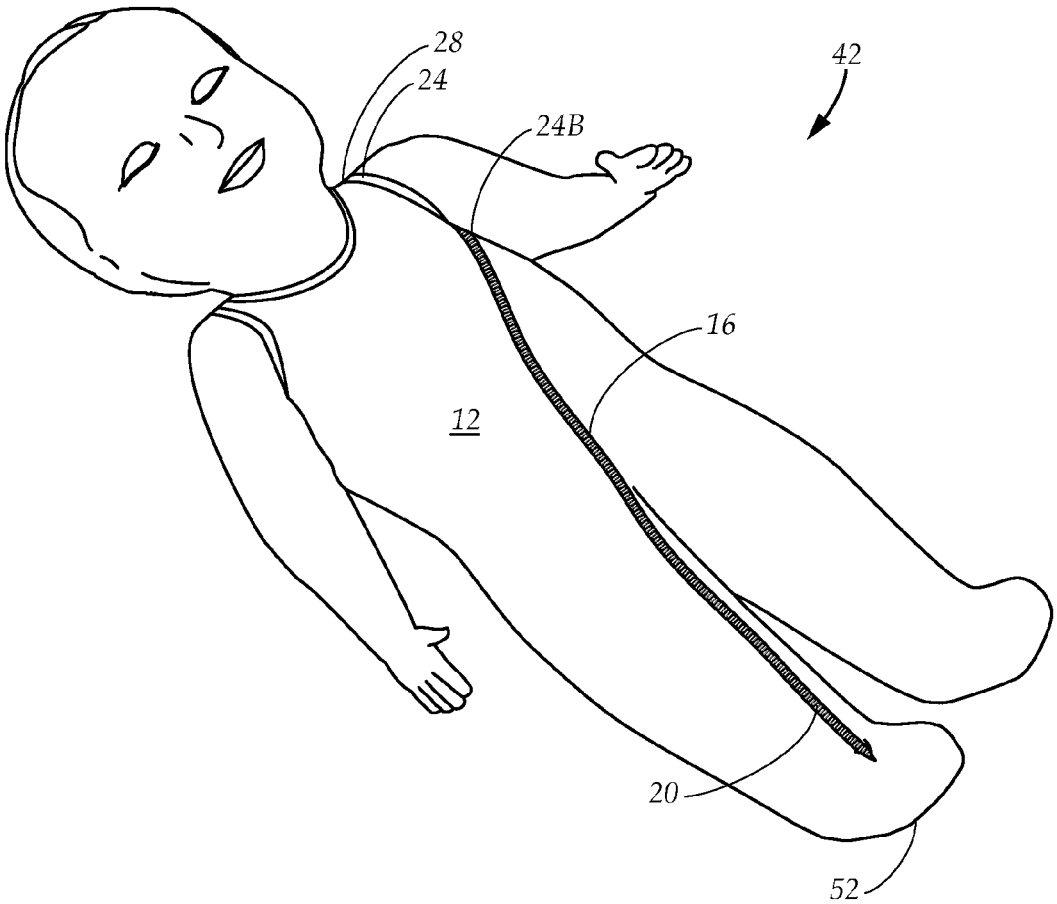
FIG. 2 is perspective view of an example embodiment of a wearable blanket footed sleeper with a closed diagonal opening.

FIG. 2 shows another example embodiment of a wearable blanket, a footed sleeper 40. The footed sleeper 40 has the diagonal opening 16 with the closure 20 extending from the bottom 24B of the armhole 24 to an opposite foot 52 across the front panel 12. The front panel 12 and back panel 14 couple together as described hereinabove with regard to the various example embodiments of the sleep sack. In one example embodiment of the footed sleeper 40, the shoulder 28 can be selectively open. In another example embodiment, the footed sleep 40 has sleeves and the opening terminates at the shoulder 28.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an improved wearable blanket. The disclosure is illustrated by example in the drawing figures, and throughout the written description. It should be understood that numerous variations are possible, while adhering to the inventive concept. Such variations are contemplated as being a part of the present disclosure.

What is claimed is:

1. A sleep sack for an infant, comprising:

a front panel having an interior surface, a top portion with a top edge, a bottom portion with a bottom edge, a pair of side edges, and a vertical mid-section between the top portion and the bottom portion;

a back panel having an interior surface, a top portion a top edge, a bottom portion with a bottom edge, a pair of side edges, and a vertical mid-section between the top portion and the bottom portion, the bottom edge of the back panel coupling to the bottom edge of the front panel, the side edges of the back panel partially coupling to the side edges of the front panel forming a side seam, the side edges open near the top edges of the top portions of the coupled panels forming a pair of armholes;

a diagonal opening with a closure extending from one armhole to the bottom edge of the bottom portion of the front panel; and a crotch covering, having a front portion with a top edge and a back portion with a top edge, the top edge of the front portion attaching to the the interior surface of the front panel at the vertical mid-section of the front panel, the top edge of the back portion attaching to the interior surface at the vertical mid-section of the back panel, the front portion of the crotch covering and the back portion of the crotch covering each having a bottom edge, the bottom edges selectively coupling together forming a crotch, the crotch covering configured for securing an infant's lower body in the sleep sack when the portions couple together.

2. The sleep sack as described in claim 1, wherein the bottom edge of the front portion of the crotch covering couples to the bottom edge of the back portion of the crotch covering by a fastener.

3. The sleep sack as described in claim 2, wherein the fastener is selected from the group consisting of snaps, hook and loop fasteners, buttons and magnets.

4. The sleep sack as described in claim 3, wherein the opening is diagonal across the front panel, extending from an armhole to the bottom edge of the bottom portion of the front panel bottom.

5. The sleep sack as described in claim 4, wherein the side seam has a top portion at the opening, and the armhole has a bottom edge formed at the top portion of the side seam, the diagonal opening terminating at the bottom edge of the armhole.

6. The sleep sack as described in claim 5, wherein the sleep sack has a pair of shoulders coupling the panels together at the top edges of the top portions, a first shoulder adjacent to the armhole terminating the diagonal opening, the first shoulder selectively fastening the front panel and the back panel together.

7. The sleep sack for an infant as described in claim 6, wherein the sleep garment is integral when assembled.

8. A sleep garment for an infant, comprising:

a front panel having a pair of side edges, a bottom portion with a bottom edge and a top portion with a top edge;

a back panel having a pair of side edges, a bottom portion with a bottom edge and a top portion with a top edge, the bottom edge of the back panel coupling to the bottom edge of the front panel, the side edges of the back panel partially coupling to the side edges of front panel forming a pair of side seams, the side seams open near the top portions of the coupled panels forming a pair of armholes;

a diagonal opening across the front panel extending from one armhole to the bottom edge of the front panel; and a closure for closing the diagonal opening across the front panel.

9. The sleep garment as described in claim 8, wherein the diagonal opening extends from an armhole to the bottom edge of the bottom portion of the front panel.

10. The sleep garment as described in claim 9, wherein the side seam has a top portion at the opening, and the armhole has a bottom edge formed at the top portion of the side seam, the diagonal opening at a terminating at the bottom edge of the armhole.

11. The sleep garment as described in claim 10, wherein the sleep garment has a pair of shoulders coupling the panels together at the top edge, a first shoulder adjacent to the armhole terminating the diagonal opening, the first shoulder selectively fastening the front panel and the back panel together.

12. The sleep garment for an infant as described in claim 11, wherein the sleep garment is integral when assembled.

13. The sleep garment as described in claim 12, wherein the sleep garment is a sleep sack.

14. The sleep garment as described in claim 12, wherein the sleep garment is a footed sleeper.

15. A sleep sack for an infant, comprising:

a front panel having an interior surface, a top portion with a top edge, a bottom portion with a bottom edge, a pair of side edges and a vertical mid-section between the top portion and the bottom portion;

a back panel having an interior surface, a top portion with a top edge, a bottom portion with a bottom edge, a pair of side edges and a vertical mid-section between the top portion and the bottom portion, the bottom edge of the bottom of the back panel coupling to the bottom edge of the bottom of the front panel, the side edges of the back panel partially coupling to the side edges of the front panel forming a pair of side seams, the side seams open near the top edges of the top portions of the coupled panels forming a pair of armholes;

an opening with a closure extending from one armhole to the bottom edge of the bottom portion of the front panel; and a crotch covering, having a front portion and a back portion, the front portion having a top edge attaching to the interior surface of the front panel at the vertical mid-section, the back portion having a top edge attaching to the interior surface at the vertical mid-section of the back panel, the front portion of the crotch covering and the back portion of the crotch covering each having a bottom edge the bottom edges selectively coupling together, forming a crotch and a pair of leg openings configured for securing an infant's lower body in the sleep sack.

16. The sleep sack as described in claim 15, wherein the bottom edge of the front portion of the crotch covering selectively couples to the bottom edge of the back portion of the crotch covering by a fastener.

17. The sleep sack as described in claim 16, wherein fastener is selected from the group consisting of snaps, hook and loop fasteners, buttons and magnets.

18. The sleep sack as described in claim 17, wherein the opening is diagonal across the front panel, extending from an armhole to the bottom edge of the panel bottom portion.

19. The sleep sack as described in claim 18, wherein the sleep sack has a pair of shoulders coupling the panels together at the top edges of the top portions, a first shoulder adjacent to the armhole terminating the diagonal opening, the first shoulder selectively fastening the front panel and the back panel together.

20. The sleep sack for an infant as described in claim 19, wherein the sleep garment is integral when assembled.

* * * * *